US011183158B2

(12) United States Patent
Stecher

(10) Patent No.: US 11,183,158 B2
(45) Date of Patent: Nov. 23, 2021

(54) SYSTEMS, DEVICES, AND/OR METHODS FOR SNARE DRUMS

(71) Applicant: Steven Stecher, Rancho Santa Fe, CA (US)

(72) Inventor: Steven Stecher, Rancho Santa Fe, CA (US)

( * ) Notice: Subject to any disclaimer, the term of this patent is extended or adjusted under 35 U.S.C. 154(b) by 0 days.

(21) Appl. No.: 16/256,682

(22) Filed: Jan. 24, 2019

(65) Prior Publication Data

US 2019/0228749 A1 Jul. 25, 2019

Related U.S. Application Data

(60) Provisional application No. 62/621,397, filed on Jan. 24, 2018.

(51) Int. Cl.

| | |
|---|---|
| ***G10D 13/02*** | (2020.01) |
| ***G10D 13/18*** | (2020.01) |
| ***G10D 13/10*** | (2020.01) |
| *G10D 13/16* | (2020.01) |
| *G10D 13/20* | (2020.01) |
| *G10D 13/22* | (2020.01) |

(52) U.S. Cl.

CPC ..... *G10D 13/02* (2013.01); *G10D 13/10* (2020.02); *G10D 13/18* (2020.02); *G10D 13/16* (2020.02); *G10D 13/20* (2020.02); *G10D 13/22* (2020.02)

(58) Field of Classification Search

CPC .. G10D 13/025; G10D 13/021; G10D 13/028; G10D 13/027; G10D 13/023; G10D 13/02; G10D 13/022; G10D 13/20; G10D 13/18; G10D 13/10; G10D 13/16

See application file for complete search history.

(56) References Cited

U.S. PATENT DOCUMENTS 5,739,448 A * 4/1998 Toscano ..... G10D 13/023 84/411 A

2011/0120286 A1* 5/2011 Good ..... G10D 13/02 84/415

* cited by examiner

*Primary Examiner* — Kimberly R Lockett

(74) *Attorney, Agent, or Firm* — Dale Jensen, PLC; Dale Jensen

(57) ABSTRACT

An exemplary snare drum system comprises a shell, a batter head, a snare head, and a set of wires coupled to the snare head. The system comprises a tensioner coupleable to the set of wires of the snare drum. The tensioner comprising a base, a coarse adjuster, and a fine adjuster.

7 Claims, 9 Drawing Sheets

2000

3000

6000

7000

8000

9000

SYSTEMS, DEVICES, AND/OR METHODS FOR SNARE DRUMS

CROSS-REFERENCES TO RELATED APPLICATIONS

This application claims priority to, and incorporates by reference herein in its entirety, U.S. Provisional Patent Application Ser. No. 62/621,397, filed 24 Jan. 2018.

Figure 1:
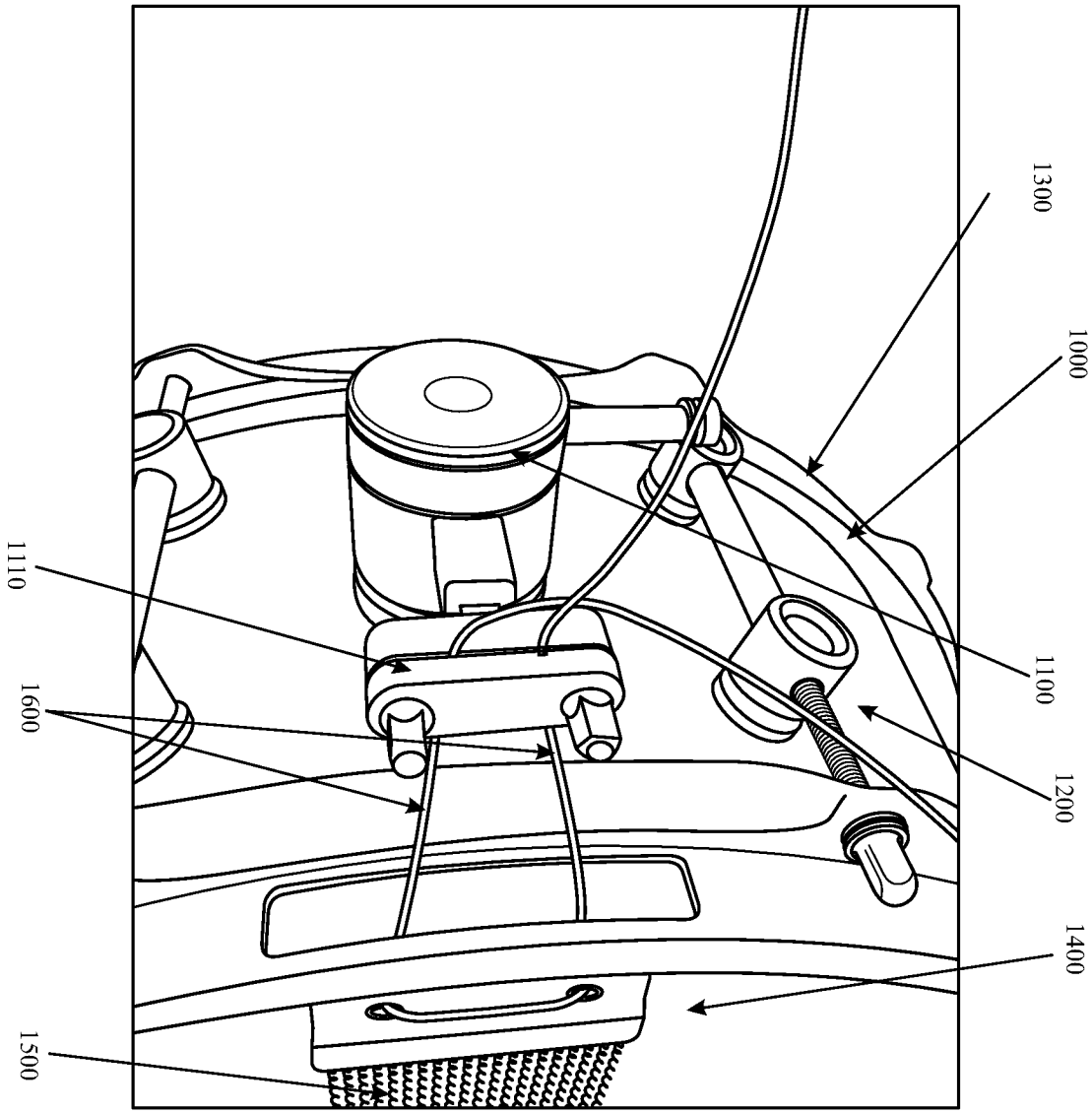
FIGS. 1-9 are executed in color.
Figure 2:
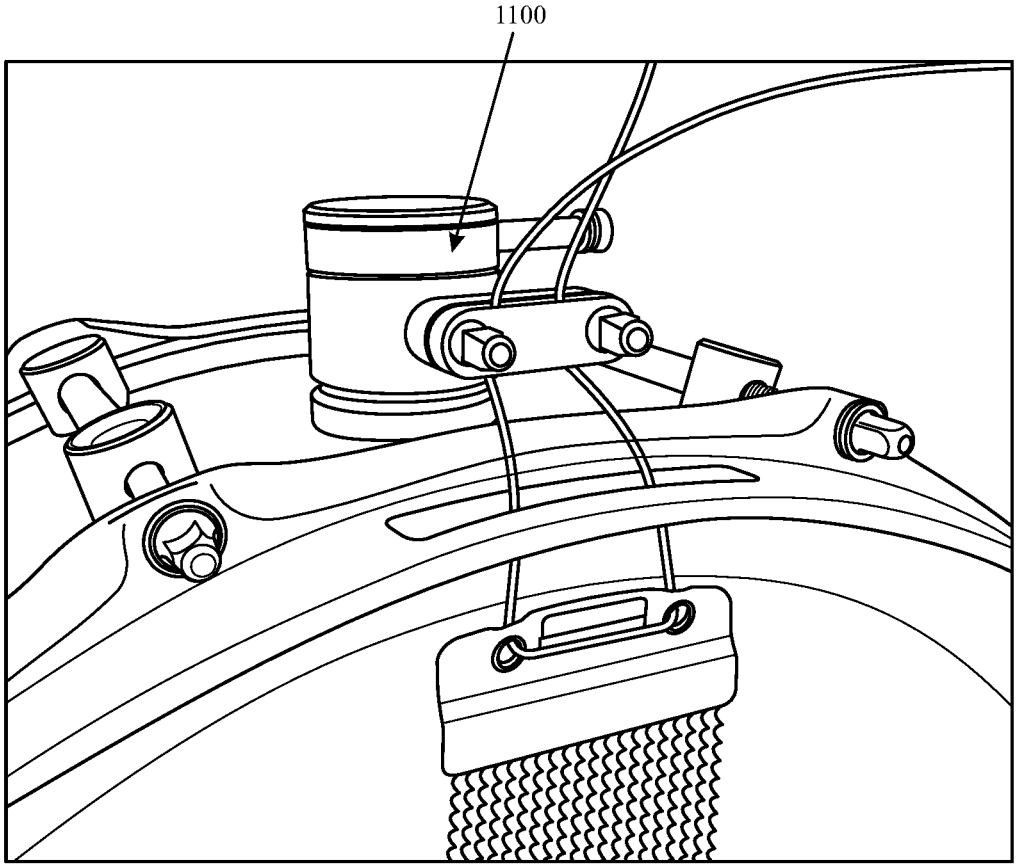
Figure 3:
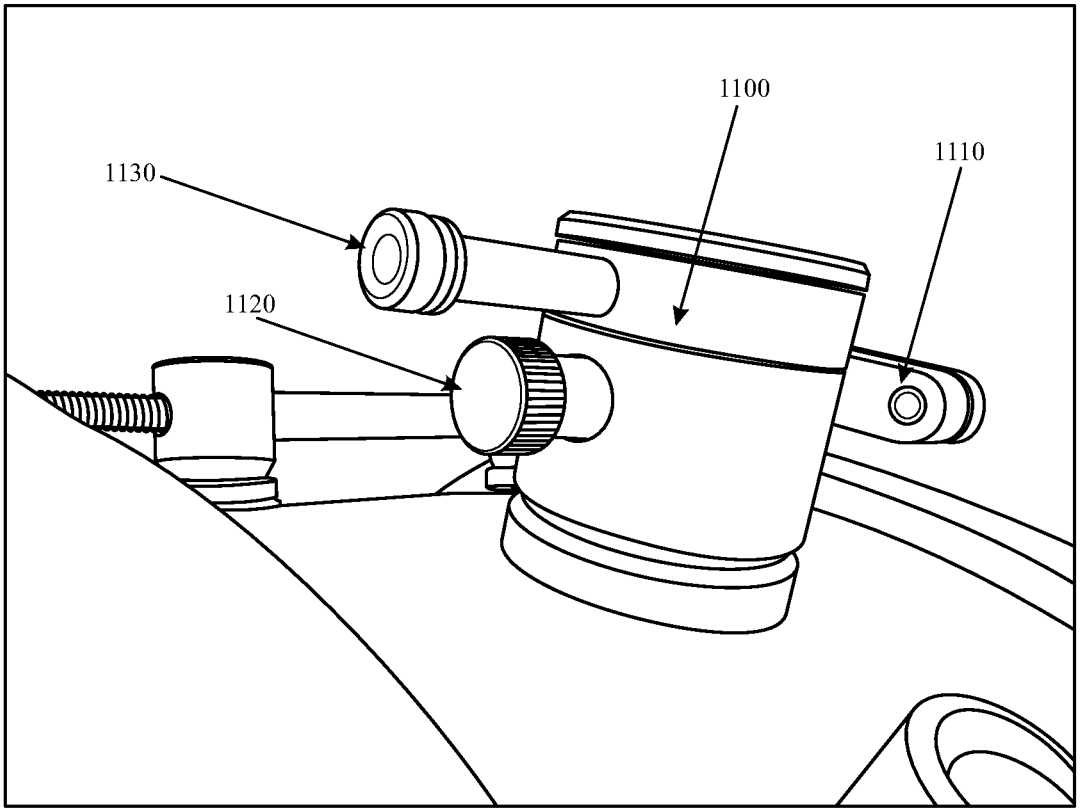
Figure 4:
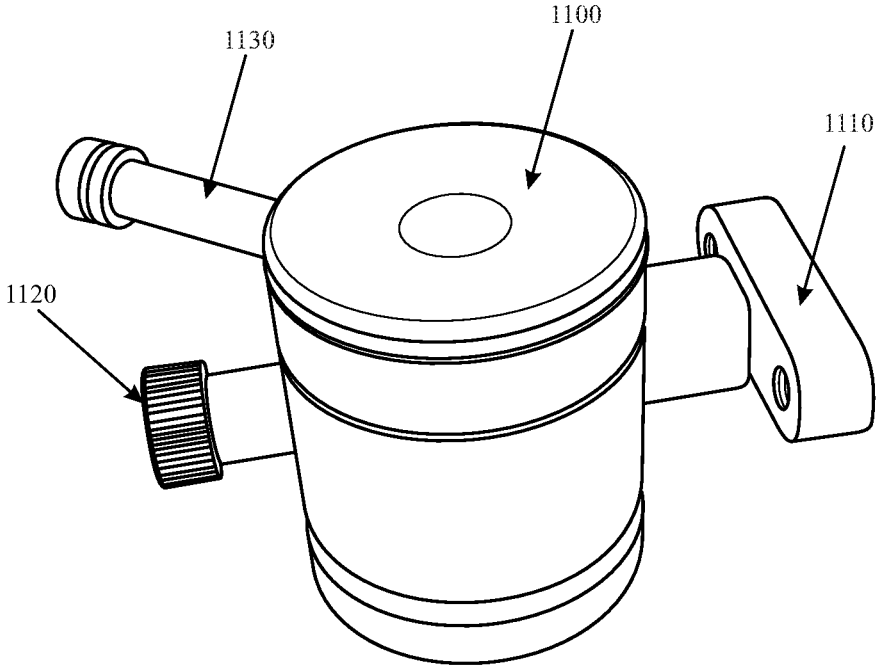
Figure 5:
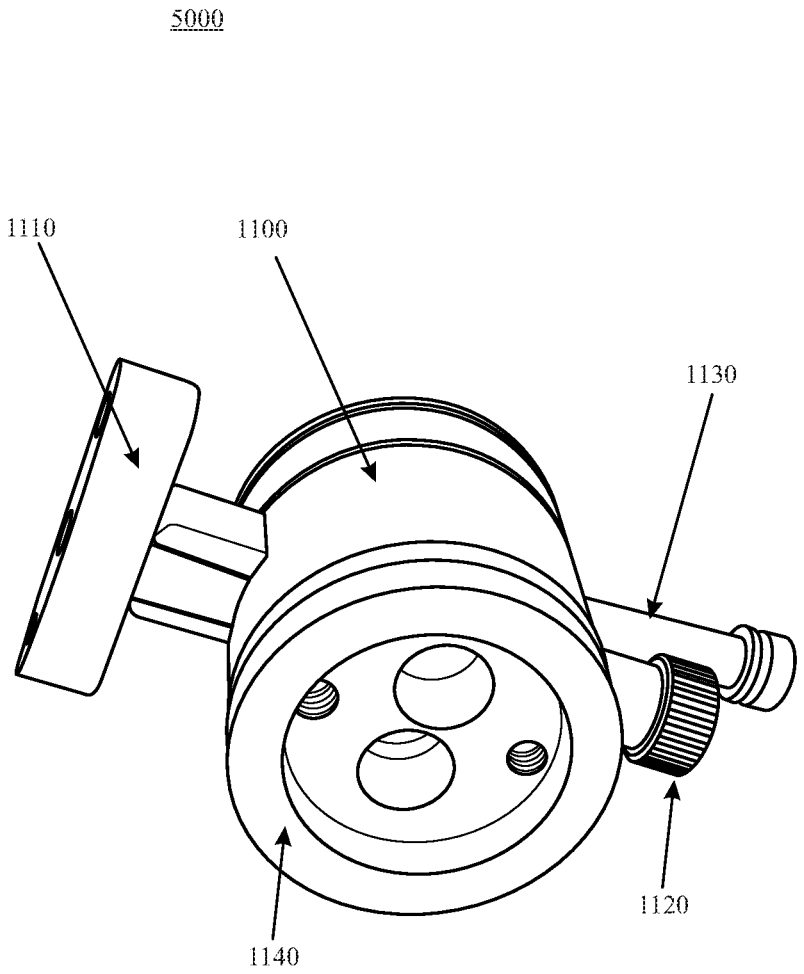
Figure 6:
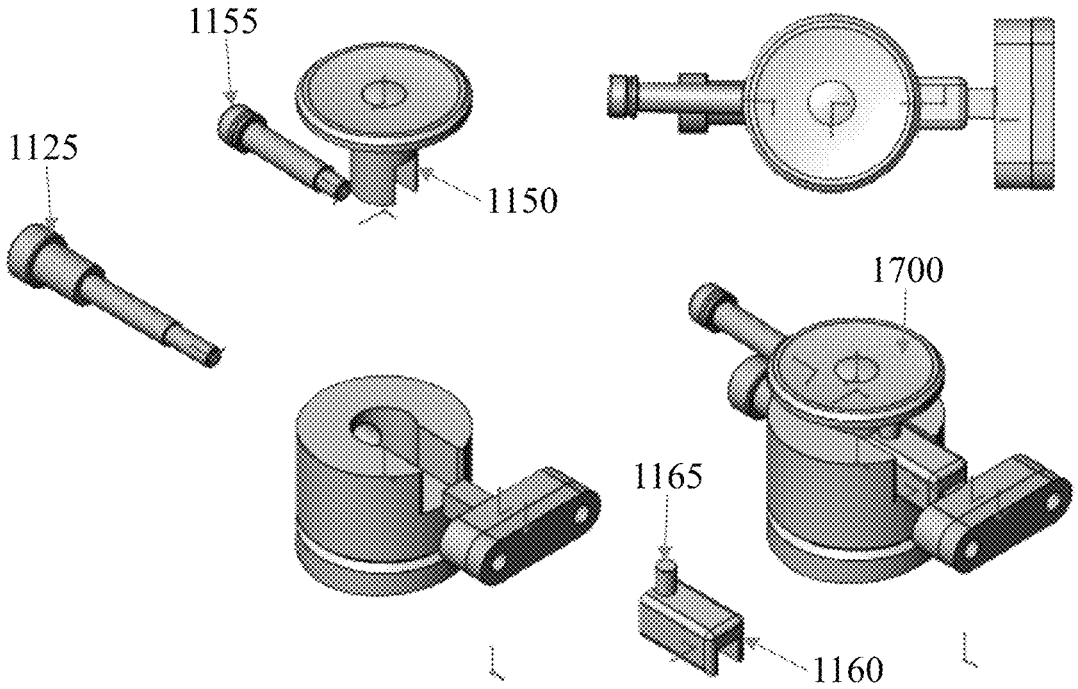
Figure 7:
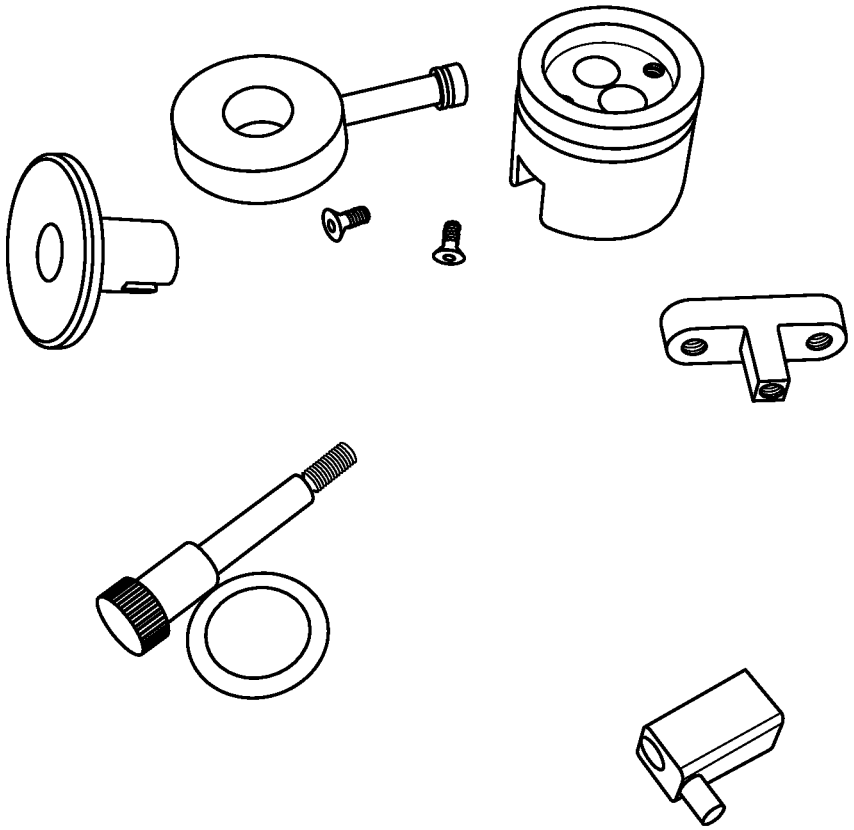
Figure 8:
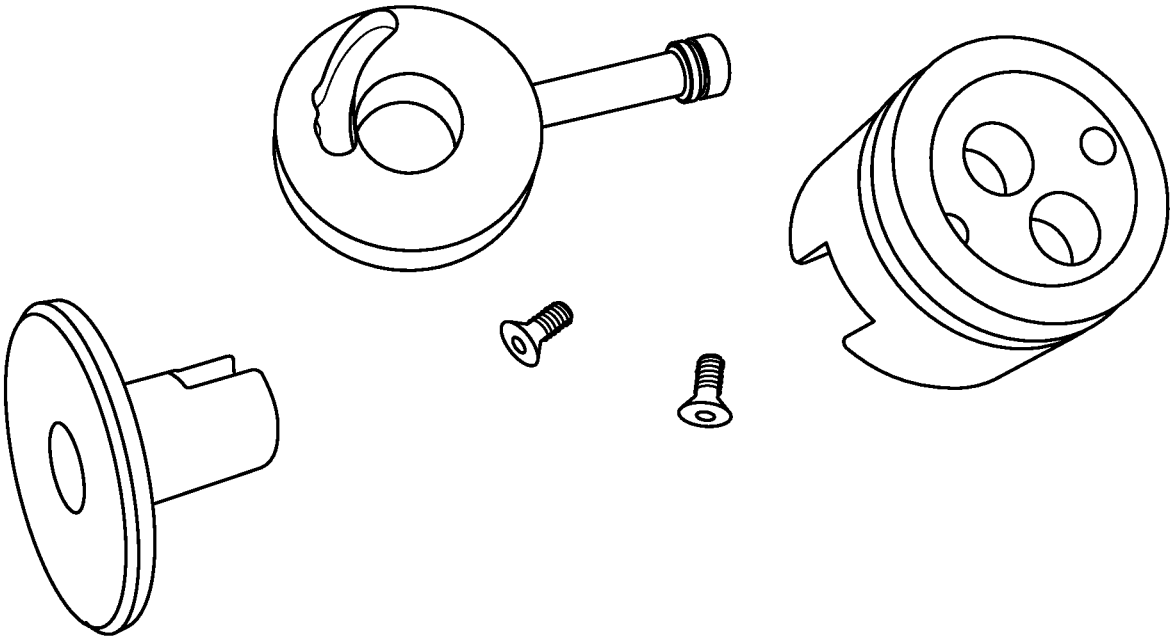
Figure 9:
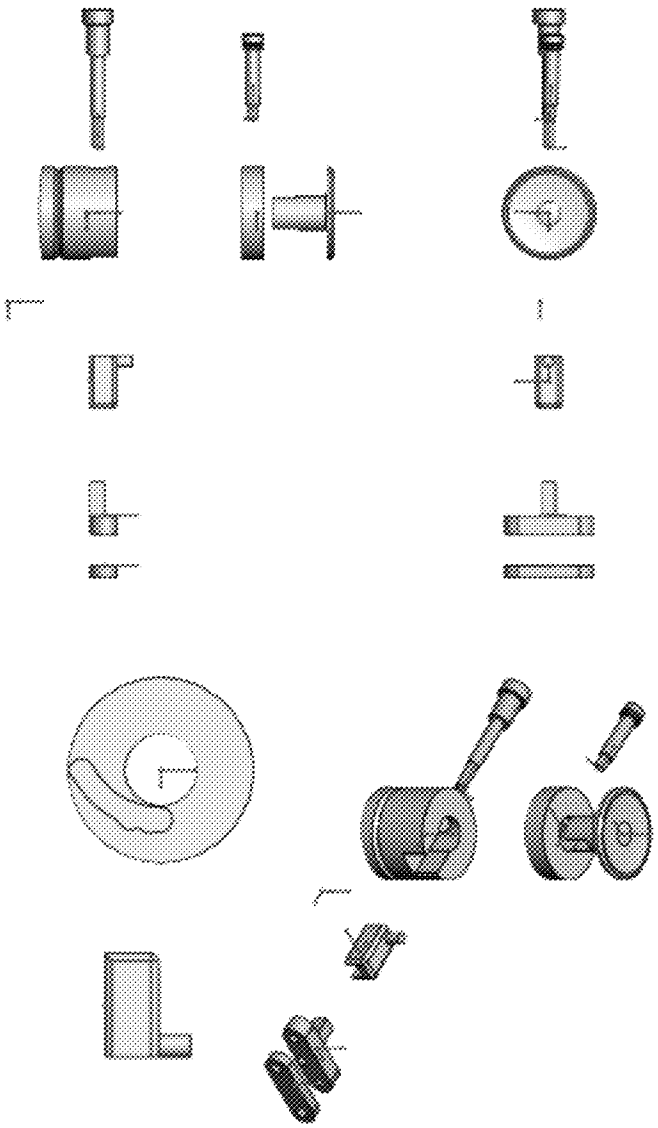

A wide variety of potential practical and useful embodiments will be more readily understood through the following detailed description of certain exemplary embodiments, with reference to the accompanying exemplary drawings in which:

FIG. 1 is a photograph of a perspective view of an exemplary embodiment of a snare drum 1000;

FIG. 2 is a photograph of a perspective view of snare drum 1000, which further illustrates exemplary tensioner 1100;

FIG. 3 is a photograph of a perspective view of snare drum 1000, which further illustrates exemplary tensioner 1100;

FIG. 4 is a photograph of a perspective view of exemplary tensioner 1100 shown decoupled from a snare drum;

FIG. 5 is a photograph of a perspective view of an exemplary embodiment of a tensioner 5000;

FIG. 6 is a set of schematic diagrams of perspective views of exemplary tensioner 1100 to show assembly of components;

FIG. 7 is a photograph of a perspective view of disassembled components of an exemplary tensioner 1100;

FIG. 8 is a photograph of a perspective view of disassembled components of exemplary tensioner 1100; and FIG. 9 is a set of schematic diagrams of perspective views of disassembled components of an exemplary tensioner 1100.

DETAILED DESCRIPTION

Certain exemplary embodiments provide an improved snare drum and control thereof.

Certain exemplary embodiments can provide a system comprising a snare drum. The snare drum comprises a shell, a batter head, a snare head, and a set of wires coupled to the snare head. The system comprises a tensioner coupleable to the set of wires of the snare drum. The tensioner comprising a base, a coarse adjuster, and a fine adjuster.

Snare drums are often used in orchestras, concert bands, marching bands, parades, drumlines, drum corps, and more. Snare drums can be components in drum sets, a collection of percussion instruments designed to be played by a seated drummer, which is used in many genres of music. Snare drums are usually played with drum sticks, but other beaters such as a brush or a rute can be used to achieve different sounds. The snare drum is a versatile and expressive percussion instrument due its sensitivity and responsiveness. The sensitivity of the snare drum allows it to respond audibly to the softest strokes, even with a wire brush; as well, it can be used for complex rhythmic patterns and engaging solos at moderate volumes. Its high dynamic range allows the player to produce powerful accents with vigorous strokes and a thundering crack (120+dB) when rimshot strokes are used.

Snare drums originated from tabors, drums first used to accompany flutes. The tabor evolved into more modern versions, such as the kit snare, marching snare, tarol snare, and/or piccolo snare, etc. Each type of drum presents a different style of percussion and size. The snare drum that one might see in a popular music concert is usually used in a backbeat style to create rhythm. In marching bands, it can do the same but is used mostly for a front beat. In comparison with the marching snare, the kit snare is generally smaller in length, while the piccolo is the smallest of the three. The snare drum is easily recognizable by its loud cracking sound when struck firmly with a drum stick or mallet. The depth of the sound varies from snare to snare because of the different techniques and construction qualities of the drum. Some of these qualities are head material and tension, dimensions, and rim and drum shell materials and construction.

Snare drums can be constructed of two heads, each of which can be made of plastic, along with a rattle of metal wires on the bottom head called the snares. The wires can also be placed on the top, as in the tarol snare, or both heads as in the case of Highland snare drums. The top head is often called the batter head because that is where the drummer strikes it, while the bottom head is called the snare head because that is where the snares are located. The tension of each head is held constant by tension rods. Tension rod adjustment allows the pitch and tonal character of the drum to be customized by the player. The strainer is a lever that engages or disengages contact between the snares and the head, and allows snare tension adjustment. If the strainer is disengaged, the sound of the drum resembles a tom because the snares are inactive. The rim is the metal ring around the batter head, which can be used for a variety of things, although it is notably used to sound a piercing rimshot with the drumstick.

The drum can be played by striking it with a drum stick or any other form of beater, including brushes, rute and/or hands, etc., each of which produce a sounding vibration from the snare wires. When using a stick, a drummer may strike the head of the drum, the rim (counterhoop), or the shell. When the top head is struck, the bottom (resonant) head vibrates in tandem, which in turn stimulates the snares and produces a cracking sound. The snares can be thrown off (disengaged) with a lever on the strainer so that the drum produces a sound reminiscent of a tom-tom. Rimshots are a technique associated with snare drums in which the head and rim are struck simultaneously with one stick (or in orchestral concert playing, a stick placed on the head and the rim struck by the opposite stick). In contemporary and/or pop and rock music, where the snare drum is used as a part of a drum kit, many of the backbeats and accented notes on snares drum are played as rimshots, due to the ever-increasing demand for their typical sharp and high-volume sound.

A commonly used alternative way to play the snare drum is known as cross stick or side stick. This is done by holding the tip of the drumstick against the drum head and striking the stick's other end (the butt) against the rim, using the hand to mute the head. This produces a dry high-pitched click, similar to a set of claves, and is especially common in Latin and jazz music. So-called "ghost notes" are very light "filler notes" played in between the backbeats in genres such as funk and rhythm and blues. The iconic drum roll is produced by alternately bouncing the sticks on the drum head, striving for a controlled rebound. A similar effect can be obtained by playing alternating double strokes on the drum, creating a double stroke roll, or very fast single strokes, creating a single stroke roll. The snares are a fundamental ingredient in the pressed (buzz) drum roll, as they help to blend together distinct strokes that are then perceived as a single, sustained sound. The snare drum is the first instrument to learn in preparing to play a full drum kit. Rudiments are sets of basic patterns often played on a snare drum.

Snare drums can be made from various wood, metal, acrylic, and/or composites (e.g., fiberglass materials), etc. In certain exemplary embodiments, a diameter for snare drums can be approximately 14 in (approximately 36 cm). Marching snare drums are deeper (taller) in size than snare drums sometimes used for orchestral or drum kit purposes, often measuring approximately 12 in deep (tall). Orchestral and drum kit snare drum shells are approximately 6 in (approximately 15 cm) deep. Piccolo snare drums are even shallower at approximately 3 in (approximately 7.6 cm) deep. Soprano, popcorn, and firecracker snare drums have diameters as small as approximately 8 in (approximately 20 cm) and can be used for higher-pitched special effects.

Certain exemplary wooden snare drum shells are constructed in plies (layers) that are heat and/or compression moulded into a cylinder. Steam-bent shells comprising one or more plies of wood can be gradually rounded into a cylinder and glued at one seam. Reinforcement rings, so-called "re-rings", can be incorporated on the inside surface of the drum shell to keep it substantially round. Segment shells can be made of multiple stacks of segmented wood rings. The segments can be glued together and rounded out by a lathe. Stave shells are constructed of vertically glued pieces of wood into a cylinder (much like a barrel) that is also rounded out by a lathe. Solid shells can be constructed of one solid piece of hollowed wood.

The heads or skins used can be a batter head (the playing surface on the top of the drum) and a resonant (bottom) head. The resonant head can be thinner than the batter head and is not beaten while playing. Rather than calfskin, certain drums use plastic (Mylar) skins of approximately 10 mils thickness, sometimes with multiple plies (usually two) of around 7 mils for the batter head. In addition, tone control rings or dots can be applied, either on the outer or inner surface of the head, to control overtones and ringing, and can be found positioned in the center or close to the edge hoops or both. Resonant heads can be only a few mils thick, to enable them to respond to the movement of the batter head as it is played. Pipe band requirements have led to the development of a Kevlar-based head, enabling very high tuning, thus producing a very high-pitched cracking snare sound.

A technique used to improve the sound quality during snare drum construction is symmetrical venting. In contrast to a standard single vent hole, air can easily travel through and around the instrument without getting caught. This rapid movement creates a smoother, stronger sound.

FIG. 1 is a photograph of a perspective view of an exemplary embodiment of a snare drum 1000, which illustrates an exemplary tensioner 1100.

Snare drum 1000 comprises a shell 1200, a batter head 1300, a snare head 1400, and a set of wires 1500 coupled to snare head 1400. Tensioner 1100 is coupleable to set of wires 1500 of snare drum 1000. Tensioner 1100 comprises a base 1110, a coarse adjuster (see course adjuster 1120 of FIG. 3) and a fine adjuster (see fine adjuster 1130 of FIG. 3). Coarse adjuster 1120 is shiftable to a plurality of discrete adjustment positions, the plurality of discrete adjustment positions ranging from a substantially tensionless state to a high tension state for the set of wires of snare drum 1000. Fine adjuster (see fine adjuster 1130 of FIG. 3) adjustable via rotation to provide smaller changes in tension for set of wires 1500 of snare drum 1000 than changes to discrete adjustment positions to the coarse adjuster (see course adjuster 1120 of FIG. 3). Base 1110 is coupleable to set of wires 1500 of snare drum 1000.

Tensioner 1100 comprises a surface 1140 that, when tensioner 1100 is coupled to snare drum 1000, is in direct contact with shell 1200 of snare drum 1000. Tensioner 1100 is coupled to set of wires 1500 of snare drum 1000 via a plurality of tensioning wires 1600. Tensioner 1100 comprises a head (see head 1150 of FIG. 6) that is directly coupleable to fine adjuster (see fine adjuster 1130 of FIG. 3).

The fine adjuster (see fine adjuster 1130 of FIG. 3) comprises a channel shaped component (see channel shaped component 1160 of FIG. 6) with a prong (see prong 1165 of FIG. 6), wherein a fine adjuster knob (see fine adjuster knob 1155 of FIG. 6) of fine adjuster (see fine adjuster 1130 of FIG. 3) engages with the prong (see prong 1165 of FIG. 6) to make the smaller changes in tension.

The fine adjuster (see fine adjuster 1130 of FIG. 3) comprises a channel shaped component (see channel shaped component 1160 of FIG. 6) with a prong (see prong 1165 of FIG. 6). The channel shaped component (see channel shaped component 1160 of FIG. 6) with the prong (see prong 1165 of FIG. 6) can be in directly contact with base 1110 of tensioner 1100. A fine adjuster knob (see fine adjuster knob 1155 of FIG. 6) of the fine adjuster (see fine adjuster 1130 of FIG. 3) engages with the prong (see prong 1165 of FIG. 6) to make the smaller changes in tension. Base 1110 of tensioner 1100 can be directly coupled to a course adjuster knob (see course adjuster knob 1125 of FIG. 6) of the coarse adjuster (see course adjuster 1120 of FIG. 3). Tensioner 1100 can comprise a cap (see cap 1700 of FIG. 6) that covers portions of the coarse adjuster (see course adjuster 1120 of FIG. 3), and the fine adjuster (see fine adjuster 1130 of FIG. 3).

FIG. 2 is a photograph of a perspective view of exemplary snare drum 1000, which further illustrates exemplary tensioner 1100.

FIG. 3 is a photograph of a perspective view of exemplary snare drum 1000, which further illustrates exemplary tensioner 1100.

FIG. 4 is a photograph of a perspective view of exemplary tensioner 1100 shown decoupled from a snare drum. Tensioner 1100 comprises base 1110, coarse adjuster 1120, and a fine adjuster 1130. Coarse adjuster 1120 can be shiftable to a plurality of discrete adjustment positions. The plurality of discrete adjustment positions can range from a substantially tensionless state for the snare drum wires to a high tension state. Fine adjuster 1130 can be adjusted via rotation to provide smaller changes in snare drum wire tension than discrete changes to coarse adjuster 1120.

FIG. 5 is a photograph of a perspective view of exemplary tensioner 1100, which comprises base 1110, a coarse adjuster 1120, and a fine adjuster 1130. In the view shown in FIG. 5, coarse adjuster 1120 is shown in a different position relative to fine adjuster 1130 as compared to the orientation of coarse adjuster 1120 and fine adjuster 1130 as shown in FIG. 4.

FIG. 6 is a set of schematic diagrams of perspective views of exemplary tensioner 1100 to show assembly of components.

FIG. 7 is a photograph of a perspective view of disassembled components of an exemplary tensioner 1100.

FIG. 8 is a photograph of a perspective view of disassembled components of exemplary tensioner 1100.

FIG. 9 is a set of schematic diagrams of perspective views of disassembled components of an exemplary tensioner 1100.

Definitions

When the following terms are used substantively herein, the accompanying definitions apply. These terms and definitions are presented without prejudice, and, consistent with the application, the right to redefine these terms during the prosecution of this application or any application claiming priority hereto is reserved. For the purpose of interpreting a claim of any patent that claims priority hereto, each definition (or redefined term if an original definition was amended during the prosecution of that patent), functions as a clear and unambiguous disavowal of the subject matter outside of that definition.

a—at least one.
activity—an action, act, step, and/or process or portion thereof
adapter—a device used to effect operative compatibility between different parts of one or more pieces of an apparatus or system.
and/or—either in conjunction with or in alternative to.
aperture—a hole or opening in something.
apparatus—an appliance or device for a particular purpose
associate—to join, connect together, and/or relate.
base—a tensioner component that couples the tensioner to a set of wires coupled to a snare head of a snare drum.
batter head—the part of the drum that is actually struck (sometimes referred to as the "top head").
body—a main portion of a physical object.
can—is capable of, in at least some embodiments.
cap—a component of a tensioner that covers portions of the coarse adjuster, and the fine adjuster.
cause—to produce an effect.
chamfered—having an edge of a structure that is substantially not perpendicular to the faces of the piece.
channel shaped component—a component having a cross section portion with a base and two upturned sides, wherein each of the two upturned sides join the base at substantially right angles.
comprising—including but not limited to.
configure—to make suitable or fit for a specific use or situation.
connect—to join or fasten together.
constructed to—made to and/or designed to.
convert—to transform, adapt, and/or change.
core—a central part of a device and/or system.
coupleable—capable of being joined, connected, and/or linked together.
coupling—linking in some fashion.
course adjuster—a tensioner component that is shiftable to a plurality of discrete adjustment positions that adjust tension on a set of wires coupled to a snare head of a snare drum.
create—to bring into being.
cylindrical—is a shape defined by a surface formed by the points at a fixed distance from a given straight line called the axis of the cylinder.
define—to establish the outline, form, or structure of
determine—to obtain, calculate, decide, deduce, and/or ascertain.
device—a machine, manufacture, and/or collection thereof.
direct contact—a state where component surfaces touch substantially without an intervening component or intervening space.
discrete adjustment positions—selectable positions of a knob that control tension of a set of wires of a snare drum.
engage with—to be in contact and interact with.
fastener—a hardware device that mechanically joins or affixes two or more objects together.
fine adjuster—a tensioner component that is adjustable via rotation to provide smaller changes in tension for a set of wires of a snare drum than discrete changes to a coarse adjuster.
head—a part of a tensioner via which a fine adjustment knob is coupled to the tensioner.
high tension state—a condition where a set of wires of a snare drum are held in substantially as high of a tension as is possible.
hold—to fix something in position.
install—to connect or set in position and prepare for use.
instrument—a device and/or system used to create music.
knob—a rounded handle or dial.
lower—nearer to a bottom of a device and/or system when the device and/or system is oriented in its designed operative position.
lug—a projecting piece by which components of a percussion instrument are coupled.
match—to fit together.
may—is allowed and/or permitted to, in at least some embodiments.
method—a process, procedure, and/or collection of related activities for accomplishing something.
move—to reposition relative to something else.
percussion instrument—a device or system that makes musical sounds via being struck or scraped by an object (including attached or enclosed beaters or rattles); struck, scraped or rubbed by hand; or struck against another similar instrument.
plurality—the state of being plural and/or more than one.
position—a location relative to something else.
predetermined—established in advance.
prong—a projecting part of an object.
provide—to furnish, supply, give, and/or make available.
receive—to get as a signal, take, acquire, and/or obtain.
relative—in comparison to something else.
repeatedly—again and again; repetitively.
restrain—to resist motion of something relative to something else.
section—a subpart of a device and/or system.
set—a related plurality.
shell—an outer casing of a percussion instrument.
snare drum—a percussion instrument that produces a sharp staccato sound when the head is struck with a drum stick, due to the use of a series of stiff wires held under tension against the lower skin.
snare head—a part of the drum that is on an opposing side of a part that is actually struck, the snare head is coupled to a series of stiff wires held under tension against its skin.
stone—a piece of rock shaped for a purpose.
substantially—to a great extent or degree.
support—to bear the weight of, especially from below.
system—a collection of mechanisms, devices, machines, articles of manufacture, processes, data, and/or instructions, the collection designed to perform one or more specific functions.
tension—a pulling force transmitted axially by means of a wire; tension might also be described as the action-reaction pair of forces acting at each end of the wire.

tensioner—a device that applies a force to create or maintain tension on a a set of wires coupled to a snare head of a snare drum.

tensioning wires—wires that are coupleable to a set of wires of a snare drum that adjust sound quality of the snare drum.

tensionless state—a snare drum condition where a set of wires of a snare drum are substantially not under tension.

upper—nearer to a top of a device and/or system when the device and/or system is oriented in its designed operative position.

via—by way of and/or utilizing.

wire—a single, cylindrical, strand of metal.

wood—the hard fibrous material that forms the main substance of the trunk or branches of a tree.

NOTE

Still other substantially and specifically practical and useful embodiments will become readily apparent to those skilled in this art from reading the above-recited and/or herein-included detailed description and/or drawings of certain exemplary embodiments. It should be understood that numerous variations, modifications, and additional embodiments are possible, and accordingly, all such variations, modifications, and embodiments are to be regarded as being within the scope of this application.

Thus, regardless of the content of any portion (e.g., title, field, background, summary, description, abstract, drawing figure, etc.) of this application, unless clearly specified to the contrary, such as via explicit definition, assertion, or argument, with respect to any claim, whether of this application and/or any claim of any application claiming priority hereto, and whether originally presented or otherwise:

there is no requirement for the inclusion of any particular described or illustrated characteristic, function, activity, or element, any particular sequence of activities, or any particular interrelationship of elements;

no characteristic, function, activity, or element is "essential";

any elements can be integrated, segregated, and/or duplicated;

any activity can be repeated, any activity can be performed by multiple entities, and/or any activity can be performed in multiple jurisdictions; and any activity or element can be specifically excluded, the sequence of activities can vary, and/or the interrelationship of elements can vary.

Moreover, when any number or range is described herein, unless clearly stated otherwise, that number or range is approximate. When any range is described herein, unless clearly stated otherwise, that range includes all values therein and all subranges therein. For example, if a range of 1 to 10 is described, that range includes all values therebetween, such as for example, 1.1, 2.5, 3.335, 5, 6.179, 8.9999, etc., and includes all subranges therebetween, such as for example, 1 to 3.65, 2.8 to 8.14, 1.93 to 9, etc.

When any claim element is followed by a drawing element number, that drawing element number is exemplary and non-limiting on claim scope. No claim of this application is intended to invoke paragraph six of 35 USC 112 unless the precise phrase "means for" is followed by a gerund.

Any information in any material (e.g., a United States patent, United States patent application, book, article, etc.) that has been incorporated by reference herein, is only incorporated by reference to the extent that no conflict exists between such information and the other statements and drawings set forth herein. In the event of such conflict, including a conflict that would render invalid any claim herein or seeking priority hereto, then any such conflicting information in such material is specifically not incorporated by reference herein.

Accordingly, every portion (e.g., title, field, background, summary, description, abstract, drawing figure, etc.) of this application, other than the claims themselves, is to be regarded as illustrative in nature, and not as restrictive, and the scope of subject matter protected by any patent that issues based on this application is defined only by the claims of that patent.

What is claimed is:

1. A system comprising:

a snare drum, the snare drum comprising a shell, a batter head, a snare head, and a set of wires coupled to the snare head; and a tensioner, the tensioner coupleable to the set of wires of the snare drum, the tensioner comprising a base, a coarse adjuster, and a fine adjuster, wherein, the coarse adjuster is shiftable to a plurality of discrete adjustment positions, the plurality of discrete adjustment positions ranging from a substantially tensionless state to a high tension state for the set of wires of the snare drum, the fine adjuster adjustable via rotation to provide smaller changes in tension for the set of wires of the snare drum than changes to discrete adjustment positions to the coarse adjuster, wherein the tensioner is coupled to the set of wires of the snare drum via a plurality of tensioning wires, and wherein the tensioner comprises a cap that covers portions of the coarse adjuster, and the fine adjuster.

2. The system of claim 1, wherein:

the base that is coupleable to the set of wires of the snare drum.

3. The system of claim 1, wherein:

the tensioner comprises a surface that, when the tensioner is coupled to the snare drum, is in direct contact with the shell of the snare drum.

4. The system of claim 1, wherein:

the tensioner comprises a head that is directly coupleable to the fine adjuster.

5. The system of claim 1, wherein:

the fine adjuster comprises a channel shaped component with a prong, wherein a fine adjuster knob of the fine adjuster engages with the prong to make the smaller changes in tension.

6. The system of claim 1, wherein:

the fine adjuster comprises a channel shaped component with a prong, wherein:

the channel shaped component with the prong is in directly contact with the base of the tensioner; and a fine adjuster knob of the fine adjuster engages with the prong to make the smaller changes in tension.

7. The system of claim 1, wherein:

the base of the tensioner is directly coupled to a course adjuster knob of the coarse adjuster.

* * * * *